US005725428A

United States Patent [19]

Achmüller

[11] Patent Number: 5,725,428

[45] Date of Patent: Mar. 10, 1998

[54] VIDEO SLOT MACHINE

[75] Inventor: Klaus Achmüller, Kalsdorf, Austria

[73] Assignee: Atronic Casino Technology Distribution GmbH, Espelkamp, Germany

[21] Appl. No.: 401,937

[22] Filed: Mar. 9, 1995

[51] Int. Cl.[6] ..... A63F 5/04

[52] U.S. Cl. ..... 463/20; 273/143 R

[58] Field of Search ..... 463/1, 16, 20, 463/30–31; 364/410, 412; 273/139, 143 R

[56] References Cited

U.S. PATENT DOCUMENTS

| | | | |
|---|---|---|---|
| Re. 34,244 | 5/1993 | Hagiwara | 463/20 |
| 3,929,338 | 12/1975 | Busch | 463/20 |
| 4,240,635 | 12/1980 | Brown | 463/20 |
| 4,448,419 | 5/1984 | Telnaes | 273/143 R |
| 4,648,600 | 3/1987 | Olliges | 463/20 |
| 4,711,451 | 12/1987 | Pajak et al. | 273/143 R |
| 4,712,799 | 12/1987 | Fraley | 463/20 |
| 5,050,881 | 9/1991 | Nagao | 273/143 R |
| 5,074,559 | 12/1991 | Okada | 273/143 R |
| 5,085,436 | 2/1992 | Bennett | 273/143 R |
| 5,102,134 | 4/1992 | Smyth | 273/143 R |
| 5,102,137 | 4/1992 | Ekiert | 273/143 R |
| 5,423,539 | 6/1995 | Nagao | 463/20 |
| 5,423,541 | 6/1995 | Nicastro et al. | 273/143 R |
| 5,511,784 | 4/1996 | Furry et al. | 273/143 R |

OTHER PUBLICATIONS

"Standard Pseudo Random Numbers", Chapter II, pp. 14–41 from lectures of Professor Dr L Afflerbach of Technical Univ. of Graz, Austria.

*Primary Examiner*—Jessica Harrison
*Assistant Examiner*—Mark A. Sager
*Attorney, Agent, or Firm*—Horst M. Kasper

[57] ABSTRACT

A slot machine device comprises an input sensor for sensing tokens delivered to the slot machine. A processor is connected to the input sensor for receiving information about tokens entered into the machine and for initiating a corresponding cycle of the slot machine. A first pseudo random number generator is connected to the processor for being triggered upon sensing a token input. A background position control unit is connected to the first pseudo random number generator for associating a plurality of position pointer addresses to the signal from the first pseudo random number generator. A background reel memory includes a plurality of background reel memory sections, with each background reel memory section coordinated to a corresponding one of the plurality of position pointer addresses and connected to the processor for delivering to the processor the final configuration of this cycle. Each background reel section determines coded symbol signal values of a plurality of main display symbols with each of the main display symbols to be displayed in the center of a display zone. An output control is connected to the processor for delivering a winning payout amount in case a winning combination was delivered by the plurality of position pointer addresses of the background reel sections. A video reel memory is connected to the background reel memory for determining coded symbol signal values of subsidiary display symbols to be associated with each of the main display symbol.

20 Claims, 9 Drawing Sheets

| Fig. 1A | Fig. 1B |
|---|---|

VIDEO SLOT MACHINE

BACKGROUND OF THE INVENTION

1. Field of the Invention

The invention relates to a video slot machine, which is operated by an electronic system responding to an input of coins, tokens, or of a keyboard.

2. Brief Description of the Background of the Invention Including Prior Art

The U.S. Pat. No. Re. 34,244 to Hagiwara teaches a multiline slot machine. A screen is provided with a plurality of display zones, and the display zones are arranged in rows and columns. The reference makes a row of symbols appear sequentially and randomly to stop on each of the display zones. This is performed either electronically, optically or mechanically. A random number generator is used to provide a triggering signal for the events displayed on the display zones of the slot machine.

For every display zone of the array of rows and columns, an imaginary reel memory is used and the number of random number signals is equal to the number of display zones in the array of rows and columns. The imaginary reel memory supplies random symbol signals, which are fed to the processor to determine, based on a read only memory (ROM), the output and return of coins or money. Furthermore, the imaginary reel memory furnishes a random symbol signal to a cathode ray tube control system as well as symbol data to a cathode ray tube control system. The cathode ray tube control system is connected to a symbol memory which furnishes the display information associated with the particular symbol data delivered from the imaginary reel memory to the CRT control, and the CRT control then induces the screen to display the particular symbols based on the random numbers generated in the random number generator, the random number signal delivered from the random number generator to the imaginary reel memory associated with a corresponding display zone.

Brown in the U.S. Pat. No. 4,240,635 teaches a slot machine of a substantially electronic construction, which includes a changeable display provided by activatable matrices, a pseudo random number generator for producing stored information on demand in an apparently random manner, and a microprocessor connected between the number generator and display for effective cooperation therebetween to produce an apparently randomly selected character display. A coin sensor, a start switch, and a payout coin sensor are connected to an input sensor multiplexor, and the input sensor multiplexor in turn is connected to a central processing unit, which in turn is interacting with a pseudo random number generator, a random access memory, a read only memory, and output control multiplexors. Furthermore, a timer, resettable counters, and delay control registers, and a variable speed clock timer-roll control are connected to the central processing unit. The output of the central processing unit is further delivered to a display code converter and row/column character generator, which in turn is connected to a display unit multiplexor, which display unit multiplexor is connected to three sets of display drivers.

Pseudo random number generators are generally known. The theoretical background of selecting pseudo random number generators based on linear congruence generators is taught in the lectures of Professor Dr. L. Afflerbach of the Technical University in Graz, Austria, under the title "Standard Pseudo Random Numbers" in chapter II, beginning with section 2.2 entitled, "Linear Congruence Generators II" Section 2.2.4 about selected generators including example 2.18, which is stated on pages 14–41 of said lectures. The author shows that selections can be made in connection with linear congruence generators, which provide good pseudo random number generators.

SUMMARY OF THE INVENTION

1. Purposes of the Invention

It is an object of the present invention to provide a realistic and reliable slot machine with a plurality of simulated reels.

It is another object of the present invention to provide a simulated slot machine which is constructed such as to avoid an unauthorized breaking-in based on pandering with the electronics of the slot machine.

It is yet a further object of the present invention to provide a slot machine which shows a realistic display of a plurality of rows of reels, where the chance determination is simplified, and wherein the displayed rows of reels are theoretically not all completely independent.

It is another object of the present invention to provide a slot machine where the electronics is simplified in its mode of operation, but nevertheless allowing a fully realistic display of a plurality of rows apparently running independently.

These and other objects and advantages of the present invention will become evident from the description which follows.

2. Brief Description of the Invention

The invention apparatus according to a preferred embodiment allows to display nine reel elements arranged in three rows and three columns. This provides in a slot machine the possibility to have eight winning lines, i.e., three horizontal lines, three vertical lines and two diagonal lines for determination of any "win" situations.

Furthermore, the machine allows to provide an outstanding three-dimensional reel appearance. In addition, the status of the game can be displayed on the same screen.

According to a preferred embodiment the drawing of the symbols is performed with three virtual background reels, which exhibit in each case 256 symbols. A symbol group is drawn for each virtual background reel based on a signal derived from a pseudo random generator. The symbols displayed of the symbol group comprise three neighboring symbols. These three neighboring symbols are represented in each case as main symbols with three display zones in a column. In addition, each main symbol includes a neighboring and only in part shown adjoining symbol. The drawing of the adjoining symbol is performed based on a virtual video reel. The video reel memory comprises three virtual video reels. The displayable symbols are placed in a plural fashion onto each of the virtual video reels. If, for example, the symbol "bell" is to be illustrated, then the second pseudo random generator determines if the symbol "bell" of the first virtual video reel is to be displayed coordinated to the positions 3, 12, or 19. If, based on a second pseudo random number generator signal, the position "3" is selected, this now also determines which neighboring symbols are to be illustrated in part relative to the main "bell," i.e. in the instant case above the "bell" an upper symbol "orange" and below the "bell" a lower symbol "cherry."

While the display of the invention apparatus preferably shows a three by three reel matrix, in fact only a slot machine comprising three virtual background reels is employed, i.e. there is only one row and three columns present. Thus, the display zone elements displayed are not all independent from each other but some are interconnected based on the electronic mechanism with other fortune reels even though they appear on the screen as if they were independent. This allows to simplify the electronic mechanism associated and, consequently, saves cost and economizes with respect to the electronic requirements while obtaining a high-quality symbol generation which, with all certainty, appears to be independent and based on a random selection.

According to the present invention the simulated rotation of the individual circulating bodies is obtained by preferably employing five separate imprecise pictures, which are displayed and returned again and again, where the imprecise pictures deviate from the twenty symbols which are otherwise available to form the winning and non-winning combinations. Thus, the appearance of rotation is based on a subset of symbols which are employed and which are changing rapidly to provide the appearance of rotation of the displayed fortune reels.

In accordance with the present invention only three virtual background reels are present. Each of the virtual background reels comprises 256 symbols. One determination or drawing based on a first pseudo random number generator is represented by a symbol group associated with each virtual background reel. The symbol group comprises three symbols disposed sequentially on the virtual background reel. To each of the main symbols there are additionally adjoined, based on a second pseudo random number generator, in each case two symbols which are only represented in part above and below immediately next to those main symbols. The determination of these subsidiary symbols is performed depending on pseudo chance with the virtual video reel, where each virtual video reel is furnished with twenty symbols for each of the three virtual background reels. The main symbols are present a plurality of times on the virtual video reel. If, for example, the winning symbol "plum" is to be displayed, which symbol is present on the video reel on the positions 5, 9, and 16, then a second pseudo random number generator determines which one of the three positions 5, 9, and 16 is to be used. If the determination transmitted by the signal of the second pseudo random number generator is falling on the position 5 of the virtual video reel, then this determines the two neighboring subsidiary symbols relative position 5 with to the main symbol "plum" in the instant case. The symbol "cherry," corresponding to position 4 of the virtual video reel, in part is displayed above the symbol "plum" and the symbol "orange," corresponding to position 6 of the virtual video reel, in part is displayed below the main symbol "plum."

While the present invention specifically recites a cathode ray tube as a display, other display means such as electroluminescent screens, gas discharge displays, and liquid crystal displays can be useful. A display is particularly attractive if it is capable of displaying colors and if it is capable of representing visually a simulated motion of a fortune reel.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 3:
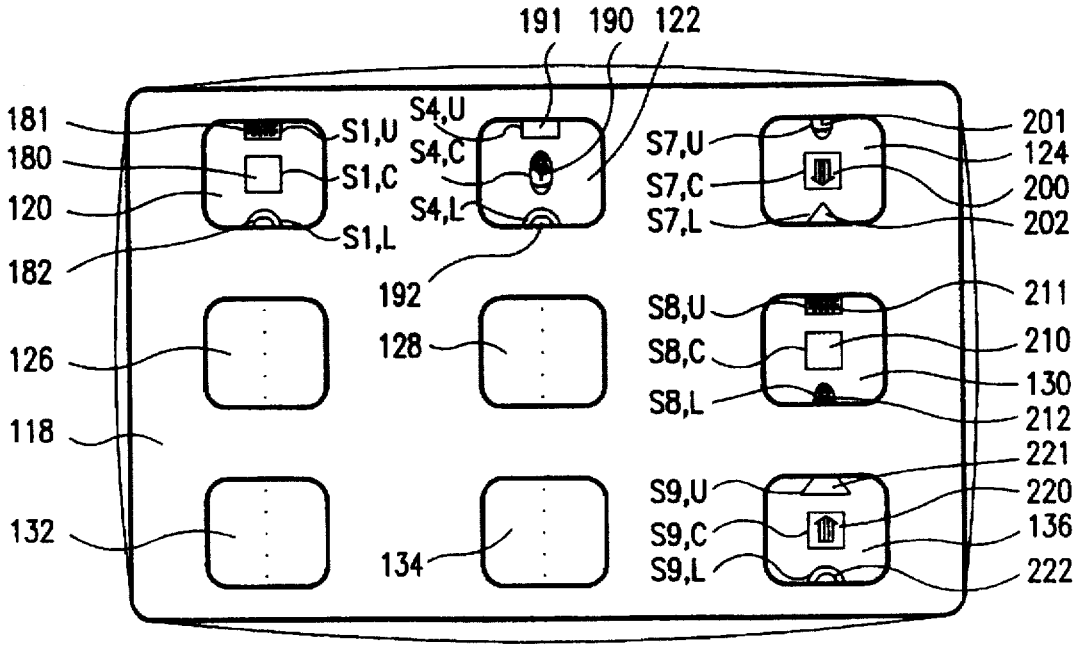
FIG. 3 is a view of the display zone arrangement of FIG. 2 illustrating schematically the symbol display.

The symbols displayed according to FIG. 3 are organized into three columns and three rows, where each row is subdivided into a main sub-row, an upper subsidiary sub-row and a lower subsidiary sub-row. For designation purposes, the display symbols in the three sub-rows will be designated as the upper subsidiary display symbol, the main display symbol, and the lower subsidiary display symbol. For example, for the first column and the first row element, there is an upper subsidiary first row, first column display symbol 181, a main first row, first column display symbol 180, and a lower subsidiary first row, first column display symbol 182. Similarly, for the second row and the third column we have the upper subsidiary second row, third column display symbol 211, the main second row, third column display symbol 210, and the lower subsidiary second row, third column display symbol 212. A main display symbol together with the upper subsidiary display symbol and the lower subsidiary display symbol will be designated as a display zone 120, 122, 124, 126, 128, 130, 132, 134, 136 representing a virtual reel defining the display region. A collection of display zones associated with a single virtual background reel will be designated as a display region.

The present invention system furnishes a realization of a multiline slot machine with a display 116 including, for example, a cathode ray tube, a matrix tube or the like, designated as CRT. The display 116 includes a display unit which allows the display of a plurality of display zones, also called visual reels, VR1 to VRp, wherein p is a natural number representing the number of display zones present; 120, 122, 124, 126, 128, 130, 132, 134, 136. The display unit can be a video screen 118, an electroluminescent screen, a liquid crystal display, a gas plasma display, a panel display etc. The arrangement of the display zones on the video screen 118 of the display 116 is in columns and rows. However, in accordance with a preferred embodiment of the present invention, the number of virtual background reels is smaller than the number of display zones and, according to a more preferred embodiment, the number of virtual background reels is only one third of the number of display zones shown on the video screen 118.

In this context, to each column of the video screen 118 there is associated an independent symbol arrangement designated as a virtual background reel, which is designated for the first column as a virtual background reel R1, for the second column as a virtual background reel R2, and for the third column as a virtual background reel R3, and which virtual background reels include a number y of each of the x-coded symbols to be displayed. y can assume a value of 256 and x can have a value of 8 different coded symbols. Thus, each coded symbol is stored in one or more preassigned locations on the virtual background reel.

Figures 1, 1A:
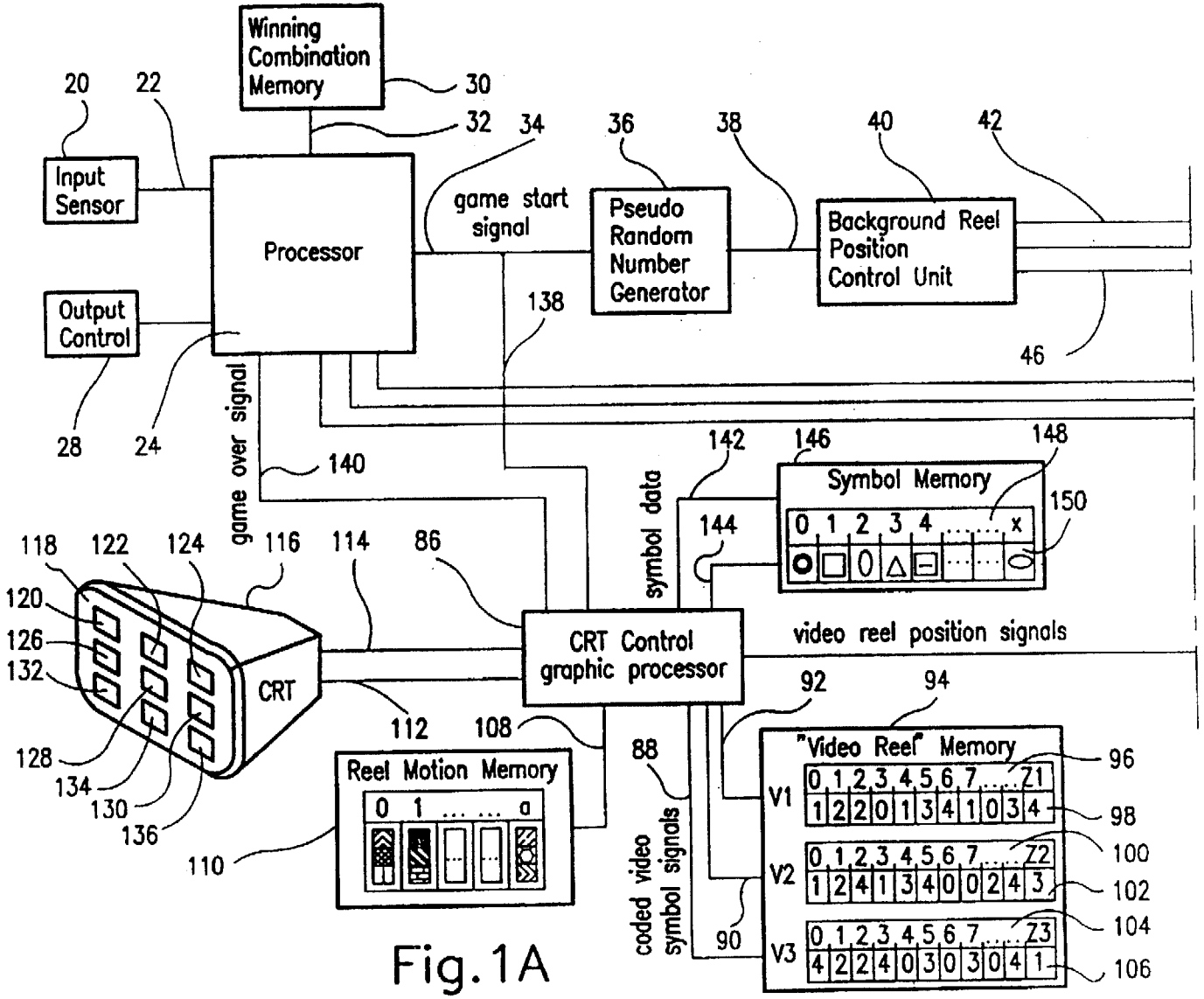
FIG. 1 shows a schematic block diagram illustrating the signal transmission between the various components of the present invention.
Figure 1B:
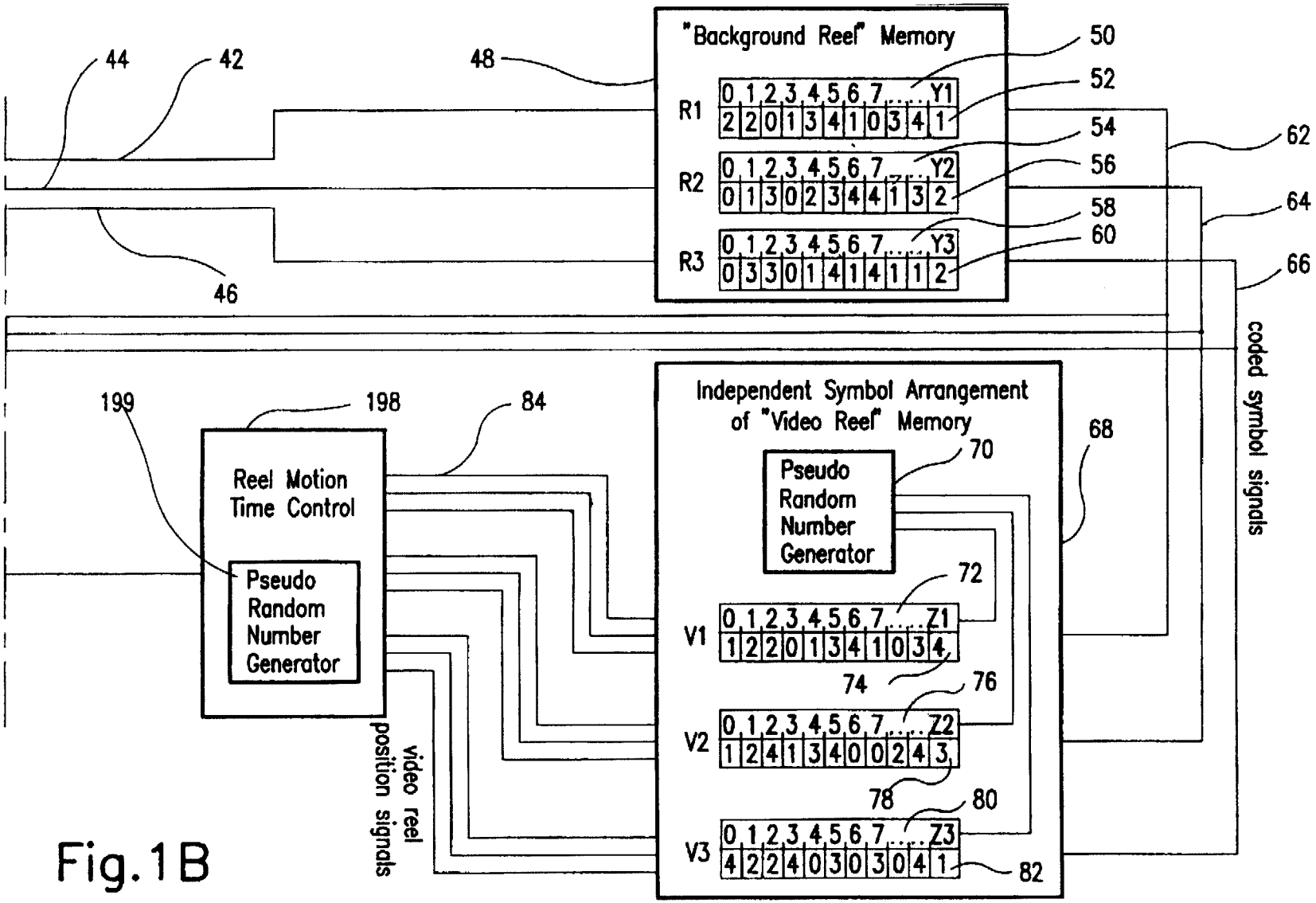

The game machine of the present invention and illustrated in FIG. 1 is provided with an input feature, such as a coin slot, a token slot, a game lever, or a keyboard. An input sensor 20 senses e.g. the number and possibly the value of the coins inserted. Depending on the number of coins inserted, the player can select a corresponding number of paylines in the field of display zones. A pull handle or other device can be provided for the player to initiate a game process. After initiating a game with a game start condition, a first pseudo random number generator 36 is employed for generating a pseudo random number corresponding to the number of columns multiplied by the number of positions y of the coordinated independent symbol arrangements furnished by each one of the virtual background reels, which then serves for effectively determining the relevant coded symbol values and signals S1,C to Sp,C, wherein p is a natural number representing the number of display zones present and wherein C represents center for the display zones VR1 to VRp, wherein p is a natural number representing the number of display zones present; 120, 122, 124, 126, 128, 130, 132, 134, 136, cf. steps 161 to 163 of the flow chart of FIG. 4. The steps employed are that the pseudo random number is generated by the first pseudo random number generator 36. Then, the drawn pseudo random number is converted to the pointer addresses 50, 54, 58 of the three background reels R1, R2, R3 of the background reel memory 48. Then, coded symbol signals 52, 56, 60 are generated in the electronic circuit section entitled "background reel memory" 48 based on the value of the virtual background reel pointer addresses 50, 54, 58 for a respective virtual background reel R1, R2, R3 and based on the contents of the background reel memory 48. At this point in time, a determination is made whether a winning situation or non-winning situation is present. Based on this determination, a coded symbol value 52, 56, 60 is determined, where the coded symbol value 52, 56, 60 corresponds to the relevant symbols for the determination of the game according to the display zones S1,C to Sp,C, wherein p is a natural number representing the number of display zones present and wherein C represents center 180, 190, 200, 210, 220 for each of the columns of the video screen 118 and then each column represents one independent symbol arrangement on a virtual background reel corresponding to a display region. The number of the symbols determined S1,C, to Sp,C, wherein p is a natural number representing the number of display zones present and wherein C represents center; 180, 190, 200, 210, 220 corresponds thus to the number of display zones or virtual reels VR1 to VRp, wherein p is a natural number representing the number of display zones present; 120, 122, 124, 126, 128, 130, 132, 134, 136. According to the determined coded symbol values for each display zone 120, 122, 124, 126, 128, 130, 132, 134, 136, the displayed images are determined from an independent symbol arrangement of a video reel memory 68 by way of a second pseudo random number generator 70. The symbols are employed for display as determined in the flow diagram of FIG. 4 (step 164), where the video reel position pointer addresses 72, 76, 80 are derived from the video reel memory 68. In this context, the x-coded symbols are present one or more times on the virtual video reel. There are proposals that z cannot be smaller than the number x of different coded symbols. Alternatively values of x=8 and of z=e.g. 20 are employed resulting in substantial repetition of coded signals on the virtual video reel.

Figure 4:
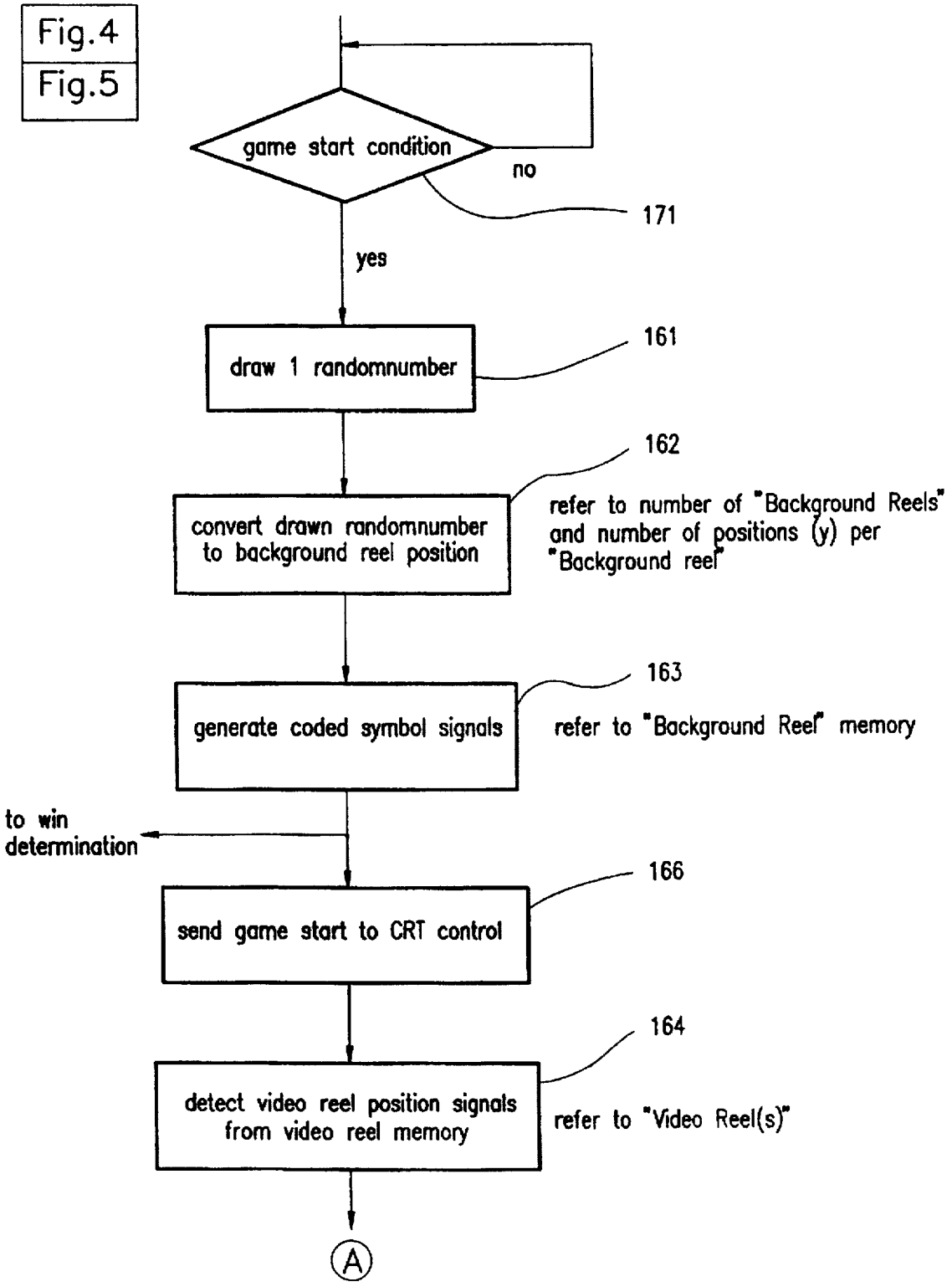
FIG. 4 is a first part of a flow chart diagram indicating the signal processing according to the present invention illustrating the processor operation.
Figure 6:
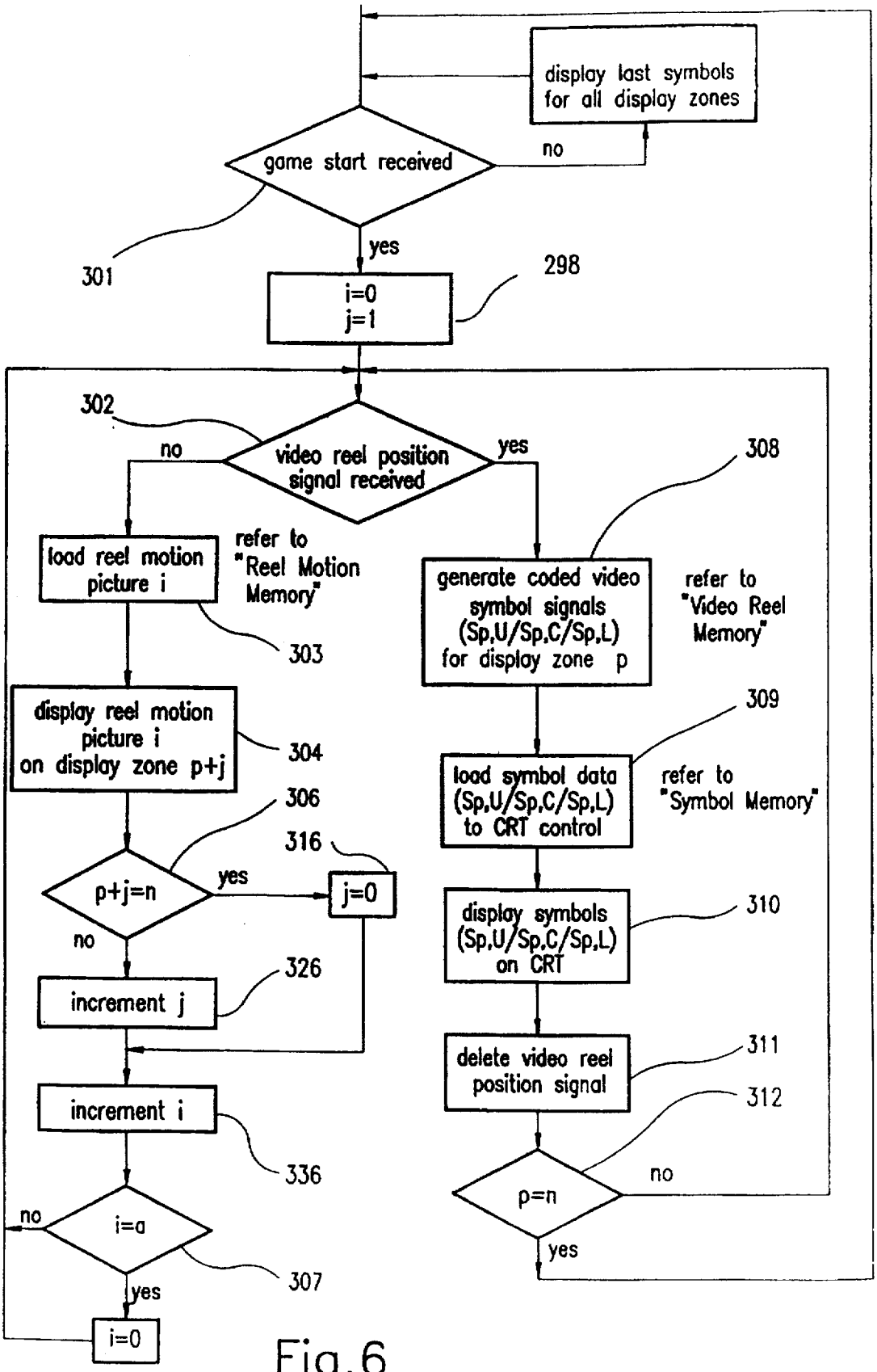
FIG. 6 is a flow chart diagram relating to the display operation in the display control circuit.

After sending the game start signal to the display control circuit 86, as illustrated in the flow chart of FIG. 4 (step 166) with the processor 886 (FIG. 8), the video screen 118 displays a number of special pictures formed as reel motion pictures to be displayed for each display zone VR1 to VRp, wherein p is a natural number representing the number of display zones present; 120, 122, 124, 126, 128, 130, 132, 134, 136, wherein the impression of a live rotating reel is generated based on the sequential display of these picture images delivered from the reel motion memory 110, as determined in the flow chart of FIG. 6 (steps 301, 302, 303, 304, 305, 306, 307).

The corresponding video reel position signal 84 is delivered to the reel motion time control circuit 198. A third pseudo number generator 199 generates signals relating to the simulation of rotation of the fortune wheels on the display. The video reel position signals and the simulated rotation signals are then transmitted to the display control circuit 86 for the respective display zone VR1 to VRp, wherein p is a natural number representing the number of display zones present; 120, 122, 124, 126, 128, 130, 132, 134, 136, based on the determined symbol region out of an independent symbol arrangement provided as a virtual video reel. After completion of a random reel motion time generated and determined by the third pseudo random number generator 199 of the reel motion time control circuit 198, the respective symbols are shown in the display zones. This process is illustrated simplified in the flow diagram of FIG. 5 at the steps 174, 176.

The coded video symbol signals 98, 102, 106, relevant for the respective display zone VR1 to VRp, wherein p is a natural number representing the number of display zones present; 120, 122, 124, 126, 128, 130, 132, 134, 136, are derived by the display control circuit 86 corresponding to the symbol arrangement of the video reel from the video reel memory 94 after the video reel position signals 88, 90, 92 have been received. This process is illustrated simplified in the flow diagram of FIG. 6 at steps 302 and 308.

The winning-relevant symbols S1,C to Sp,C, wherein p is a natural number representing the number of display zones present and wherein C represents center and the subsidiary symbols S1,U to Sp,U, wherein p is a natural number representing the number of display zones present and wherein U represents upper; S1,L to Sp,L, wherein p is a natural number representing the number of display zones present and wherein L represents lower, coming to be additionally displayed in the display zone VRp; 120, 122, 124, 126, 128, 130, 132, 134, 136, are brought to be displayed on the display 116 by the display control circuit 86 corresponding to the symbol data associated to the coded video symbol signals 142 in the symbol memory 146. This process is illustrated simplified in the flow diagram of FIG. 6 at steps 309 and 310.

After determining the random reel motion time by the reel motion time control circuit 198, the coded video symbol signals 98, 102, 106, are generated from the video reel memory 94. The load symbol data are provided by the symbol memory 146 and delivered to the display control circuit 86 and then these display symbols are displayed on the video screen 118 of the display 116 in a respective display zone 120, 122, 124, 126, 128, 130, 132, 134, 136. The display control circuit 86 can be a (cathode ray tube) CRT-controlled display control circuit.

The process of determining the random reel motion time by the reel motion time control circuit 198, of generating coded video symbol signals, of loading symbol data to the display control circuit 86, and of displaying the symbols on the display 116 are repeated until all display zones show the determined symbols, i.e. all reels have been stopped.

Figure 2:
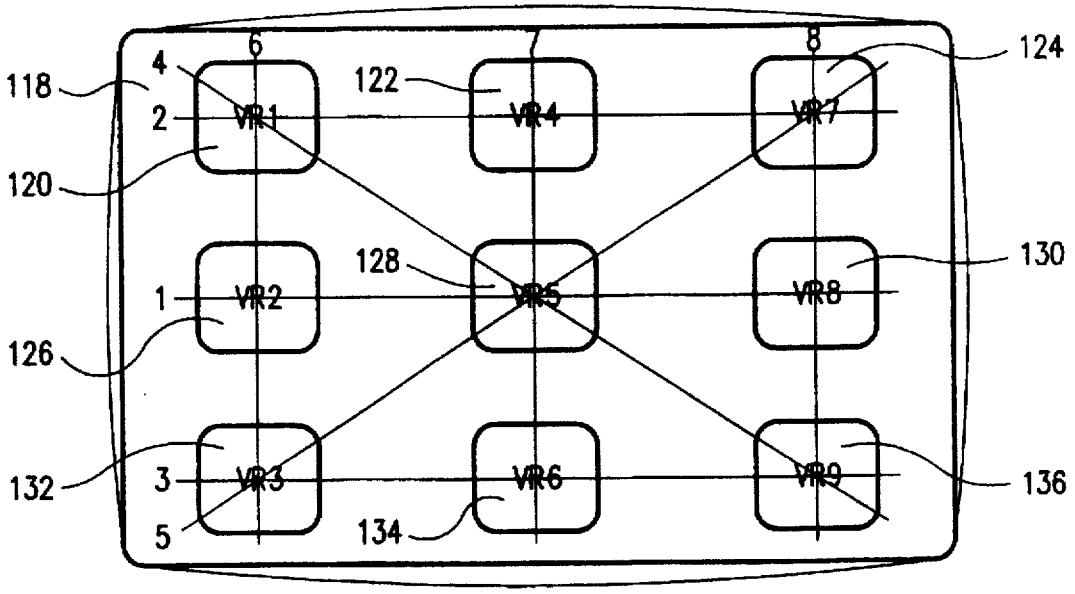
FIG. 2 is a schematic view of a display zone arrangement of a preferred embodiment.

According to a preferred embodiment of the invention corresponding to the block circuit diagram shown in FIG. 1, it is provided that, according to the arrangement of the display zones 120, 122, 124, 126, 128, 130, 132, 134, 136, and display regions 120, 126, 132; 122, 128, 134; 124, 130, 136, as particularly indicated in FIGS. 2 and 3, the display zones are disposed in three rows and three columns and the three display regions together form a single row of display regions. Based on the arrangement of the winning lines, eight possible different symbol combinations of three symbols are possible for each game. The eight different symbol combinations are provided by the three rows, by the three columns, and by the two diagonals of the three-by-three-disposed display zones.

The preferred embodiment according to the present invention is described in the following in more detail.

The first pseudo random number generator 36 delivers the pseudo random number signal through a signal line 38 to the background reel position control unit 40. The background reel position control unit 40 is connected by signal lines 42, 44, 46 to the background reel memory 48.

The background reel memory 48 comprises a first virtual background reel R1 associated with the first column of the video screen 118 representing a first display region including the display zones 120, 126, 132, a second virtual background reel R2 associated with the second column of the video screen 118 representing a second display region including the display zones 122, 128, 134, and a third virtual background reel R3 associated with the third column of the video screen 118 representing a third display region including the display zones 124, 130, 136. The respective coded symbols are derived according to the number of the columns, which are in this case three columns, and the number of positions Y1, Y2, Y3 of the respective virtual background reel R1, R2, R3, which are e.g. 256 positions in each case, R1, R2, R3, and thereby the symbols are determined, which are relevant for determining a winning amount.

For purposes of consideration we assume that the symbol arrangement of the virtual background reel R1 would be the position, where the respective address 4 in the background reel memory pointer or virtual background reel position pointer 50 would have been determined, as seen in FIG. 1. Since the symbol arrangement of the virtual background reel R1 is valid for the first display region including the display zones 120, 126, and 132, there is associated with the display zone 120 the coded symbol signal 52 of the determined position 4−1, i.e. a pointer address 3, to the display zone 126 the coded symbol signal 56 of the position of pointer address 4, and to the display zone 132 the coded symbol signal 60 of the position 4+1, i.e. pointer address 5. Corresponding to the virtual background reel memory 48, the pointer addresses 4−1, 4, 4+1 are as follows associated in providing for the display zone 120 the coded symbol signal value 1, for the display zone 126 the coded symbol signal value 3, and for the display zone 132 the coded symbol signal value 4 as shown in connection with the background reel memory 48 of FIG. 1.

The symbol arrangements of the virtual background reel R2 and of the virtual background reel R3 serve correspondingly for the determination of the coded symbol signal values 56, 60 for the second and third display regions of the columns 2 and 3, including the display zones 122, 128, 134; 124, 130, 136. The coded symbol signal values 56, 60 correspond in particular, as seen in FIG. 3, to the main display symbols 190, 200, 210, and 220.

Figure 7:
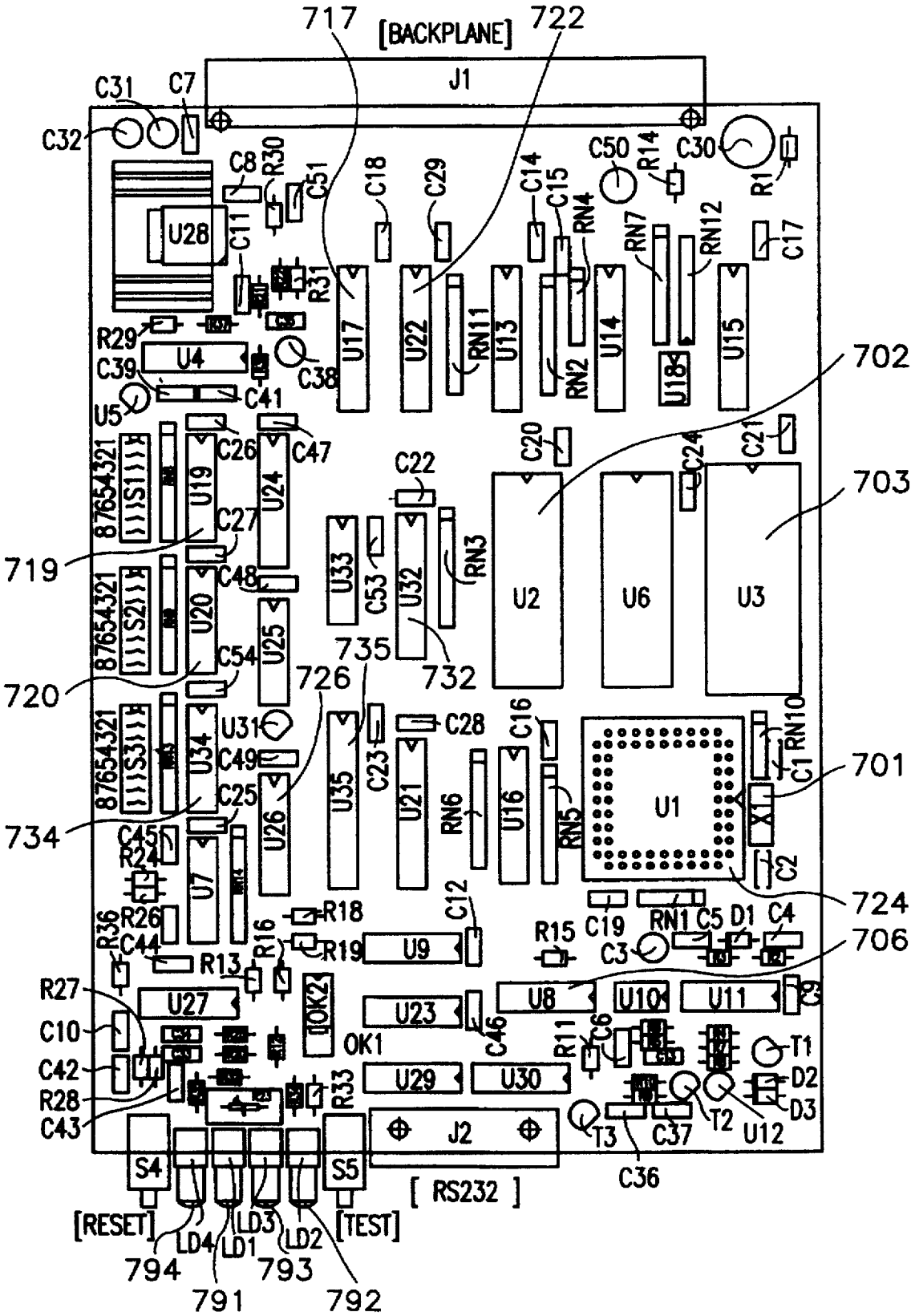
FIG. 7 is a schematic view of a main circuit board layout associated with the schematic block diagram of FIG. 1.

The nine coded symbol signal values determined in this way are provided based on the arrangement of the display zones 120, 122, 124, 126, 128, 130, 132, 134, 136 according to FIGS. 2 and 3 in the shape of a three-by-three matrix and serve, on the one hand, for the determination of the "winning" amount and, on the other hand, for the symbols to be displayed in the respective display zones. For determining the winning amount, the coded symbol signal values 52, 56, 60 are transferred through respective signal lines 62, 64, 66 back to the processor 24 (FIG. 1), 724 (FIG. 7). The processor 24, 724 compares the coded symbol signal values 52, 56, 60 delivered by the signal lines 62, 64, 66 with values stored in a winning combination memory 30 through a connection line 32. If this comparison of the coded symbol signal values 52, 56, 60, received from the virtual background reel memory 48, and the winning combinations, provided in the winning combination memory 30, results in a determination that a winning game has taken place, then the processor 24, 724 delivers a signal through a signal line 26 to the output control 28, and the output control 28 serves to deliver at an appropriate point in time, for example, an amount of coins corresponding to the respective winning amount.

On the other hand, the signal lines 62, 64, 66 also provide the coded symbol signals 52, 56, 60 to the first video reel memory 68. The first video reel memory 68 includes a second pseudo random number generator 70, and this second pseudo random number generator 70 is associated with three memory sections representing virtual video reels V1, V2, V3.

According to the determined coded symbol signal values 52, 56, 60, which are provided for the display zones 120, 126, and 132 by the virtual background reel R1, the relevant virtual video reel positions for the display zones 120, 126, and 132 are selected from a symbol arrangement of the virtual video reel position pointer address 72 of the virtual video reel V1 of the first video reel memory 68. Continuing with the previous example, the symbol signal value 1 was determined for the display zone 120. The symbol arrangement of the virtual video reel V1 of the first video reel memory 68 contains a register of values represented by a line, which is the second row of the box V1 of the video reel memory 68 with a plurality of the coded signal values or symbol signals 74 in FIG. 1 and should contain at least once each of the selected coded symbol signal values such as the coded symbol signal value 1. All the coded symbol signal values representing the value 1 in the second row with the coded symbol signals 74 of the video reel memory 68 are searched. The second pseudo random number generator 70 selects a specific one of these symbol signal values 1 in the line (74) of the coded symbol signal values 74, for example, the virtual video reel position having the respective pointer address 7 in the line (72) of the virtual video reel position pointer or virtual video reel pointer 72. Similar steps are taken for the virtual video reel V2 and the virtual video reel V3 and, according to the example of FIG. 1, the coded symbol signal value 3 is associated in the virtual video reel V1 with the virtual video reel pointer address 5, and the display element VR3 is associated with the pointer address 5+1=6 of the virtual video reel V1 and the symbol signal value 4 of the virtual background reel R1.

According to a further feature of the present invention for each display region of the video screen 118, there is used a separate virtual video reel such that the virtual video reel V1 of the first video reel memory 68 is used in connection with the virtual background reel R1 of the background reel memory 48 and for the first display region, i.e. the display zones 120, 126, 132; the virtual video reel V2 is used in connection with the virtual background reel R2 and for the second display region, i.e. the display zones 122, 128, 134, and the virtual video reel V3 is used in connection with the virtual background reel R3 and for the third display region, i.e. the display zones 124, 130, 136. Alternatively, it is possible to use, for example, a single symbol arrangement of the virtual video reel V1 for the determination of the symbol values corresponding to a line of the coded signal values or symbol signals 74 to be displayed in the respective display zones. Such a setup of a desired number of virtual video reels V1 . . . Vn depends on the effects which are to be achieved on the video screen 118. The nine signals generated in the first video reel memory according to the embodiment shown in the drawing are transferred through the signal lines 84 to a reel motion time control circuit 198. The nine signals transferred according to the invention embodiment are the pointer addresses 72, 76, 80. However, it is also conceivable that the coded symbol values 74, 78, 82 are transferred to the display control circuit 86.

The reel motion time control circuit 198 includes a third pseudo random number generator 199, which furnishes pseudo random numbers determining time periods for imaginary rotation of the imaginary fortune wheels of the display. The signals corresponding to the reel motion time periods are fed to the display control circuit 86, representing time periods determined by the third pseudo random number generator 199 for further processing.

Figure 5:
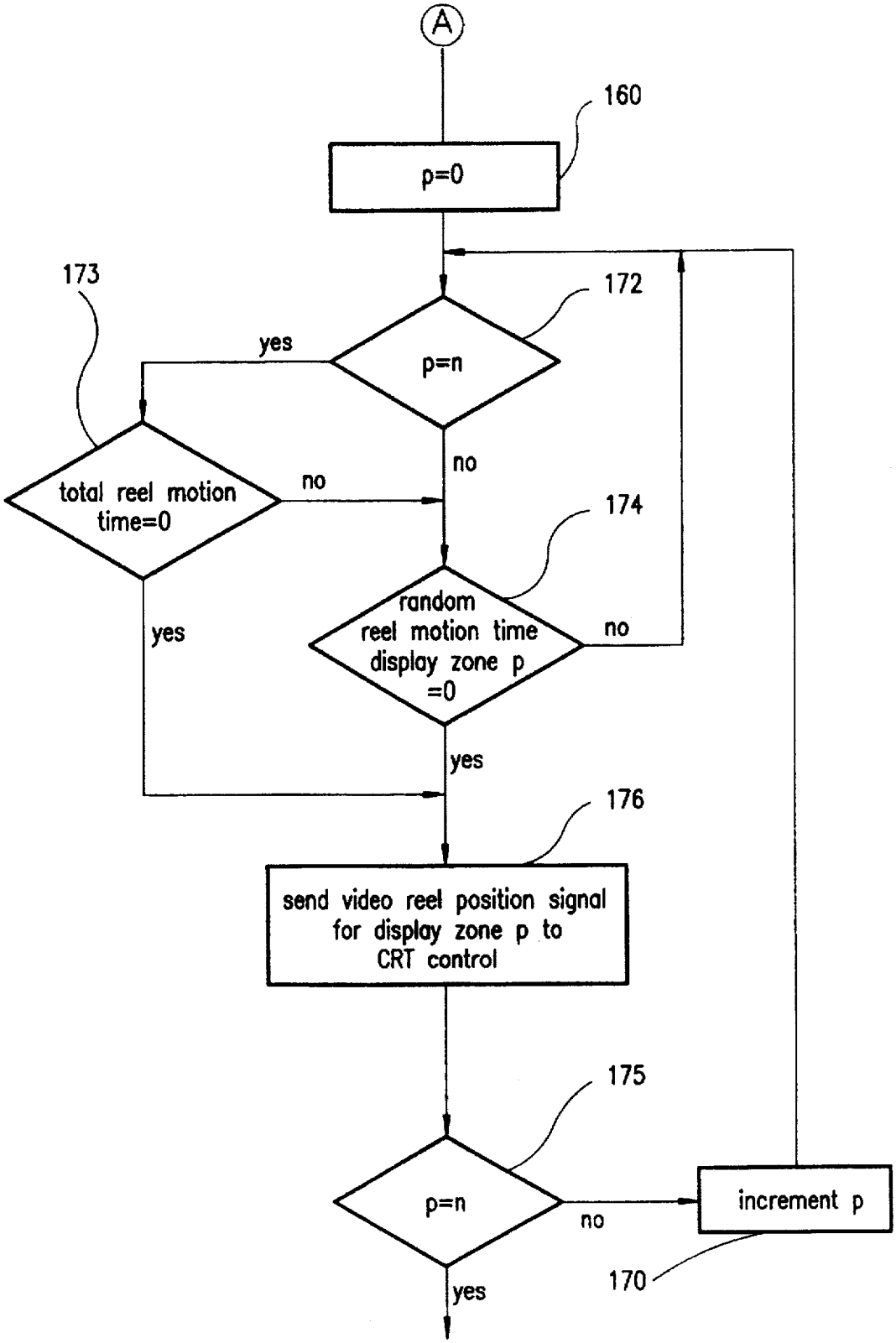
FIG. 5 is a second part of the flow chart diagram of FIG. 2, where the top of FIG. 5 is to be connected to the bottom of FIG. 4 and illustrating logic flow in a section of the cathode ray tube control circuit.

Upon occurrence of the condition a "reel motion time display region VR1=0," corresponding to the flow chart diagram in FIG. 5, decision block 174, an imagination of rotary reels is displayed in all display zones by the sequential display of a number of special pictures delivered by a reel motion memory 110. As soon as the above recited condition is fulfilled, coded symbol signal values to be illustrated are selected by the display control circuit 86 with the video reel position pointer addresses 96, 100, 104 through signal lines 88, 90, 92 delivered for the three display regions including display zones 120, 122, 124, 126, 128, 130, 132, 134, 136. According to the selected example, position 5 is selected shown in the second video reel memory 94 according to the symbol arrangement of the virtual video reel V1. The second video reel memory 94 is substantially a replica of the video reel memory 68, however, no pseudo random number generator 70 is this time present. The second video reel memory 94 was used in an embodiment of the invention which was produced with a main board and with a graphics board and where it was desirable to reduce the data flow between the main board and the graphics board. However, a preferred embodiment of the invention would combine the main board and the graphics board and thereby get by with a single video reel memory.

Since, according to the embodiment illustrated, in addition to the immediately selected symbol, which is shown in the center of a respective display zone 120, 122, 124, 126, 128, 130, 132, 134, 136, there is also shown a part of the neighboring symbols above and below said selected symbol on the respective reel, it is necessary that three coded symbol signals are taken from the symbol arrangement of the virtual video reel V1, V2, V3 for each display zone.

According to the selected example, the coded symbol signal value "3" coordinated to the video reel pointer address 5 in the virtual video reel V1 of the video reel memory 68 is employed to be displayed as the main symbol 180, S1,C, in the display zone 120, and for the upper subsidiary symbol 181, S1,U, or, respectively, the lower subsidiary symbol 182, S1,L, in the display zone 120. The symbol signal values corresponding to the pointer addresses 5−1=4 of the virtual video reel V1, i.e. "1" or, respectively, the pointer address 5+1=6, i.e. "4", are used for the subsidiary symbols 181, 182, respectively.

Signal lines 142 and 144 are connected to the display control circuit 86 corresponding to the coordination defined in the symbol memory 146. The defined coordination of the symbols is now stopped by the display control circuit 86 in the display zone 120 at the symbol according to the representation in FIG. 3, i.e. the imaginary reel of display zone 120 is stopped.

This process is repeated corresponding to the number of the display zones, i.e. virtual display reels until all display reels have stopped and the game is thus concluded and finished.

Thus, for the centered main symbol of each display zone, the background reel memory 48 with virtual background reels R1, R2, R3 is decisive as to which symbol is shown, and the first video reel memory 68 with virtual video reels V1, V2, V3 is decisive for the upper and lower subsidiary symbols shown in the display zone. The invention is associated with the advantage that three-dimensional-like pictures are shown on the video screen 118 simulating a plurality of fortune reels.

The volume of data used for such three-dimensional pictures on a display in a continuous flow state is very large. Consequently, it is desirable that the representation of rotating reels is not an actual film image of such rolling reels, but is provided in a suggestive way. Consequently, during the action of the reel motion, the subsidiary symbols are not sequentially displayed. There are used specific pictures and they contain a current information. Since during such speedy motion of the fortune reel, the eye is not capable of following the displayed pictures precisely, it is sufficient to provide blurred pictures for the subsidiary symbols of the reels. These blurred pictures represent the motion. After termination of this simulated motion, there occurs an instant stop associated with the showing of a winning or non-winning symbol, where the respective time period of the simulated motion is determined by the signals delivered from the third pseudo random number generator 199.

The virtual background reels R1, R2, R3 are each provided with 256 positions and thus the maximum range of a pseudo random number for three rows for three virtual background reels R1, R2, R3 would be the multiple of 256×256×256−1 for the possible winning combination. Thus, even though in the example it appears that the nine main symbols in the display zones on the video screen 119 are selected by nine individual fortune reels, the actual win determination is made by three individual virtual background reels R1, R2, R3, where each of these three virtual background reels R1, R2, R3 is associated with 256 positions. This construction provides a reduced number of virtual reels used for determination relative to the number of fortune reels, which are displayed.

The game is operated in the following way:

After the game has been initiated, a game start signal is fed from the processor 24 by a signal line 34 to the first pseudo random number generator 36 and by a signal line 138 to the display control circuit 86. The first pseudo random number generator 36 then generates a pseudo random number and transmits this pseudo random number through a signal line 38 to the background reel position control unit 40. The background reel position control unit 40 delivers signals through signal lines 42, 44, 46 to the background reel memory 48 containing the virtual background reels R1, R2, R3.

If the virtual background reel R1 has 256 positions, the virtual background reel R2 has also 256 positions, the virtual background reel R3 has also 256 positions, then there is a total number of 256×256×256−1 different positions available and, consequently, the pseudo random number should be limited in size to such a plurality of possible numbers, wherein the pseudo random number is then transformed in the background reel position control unit 40 into three separate signals, with one separate signal for each of the virtual background reels R1, R2, and R3. The 256 positions are defined by pointer addresses 0, 1, 2, 3 shown in the row (50) of the pointer address 50 of the virtual background reel R1. Each of the addresses of the background reel memory pointer 50 is associated with a coded symbol value of the row of the coded symbol signal values 52 of the virtual background reel R1. The selected value of the coded symbol signal values 52 of the virtual background reel R1 is transmitted by signal lines 62 to the video reel memory 68. The video reel memory 68 shows in the row of the coded symbol signal values 74 of the virtual video reel V1 the same type of coded symbol values as the values which also make up the row (52) of coded symbol signal values 52 of the virtual background reel R1.

Each certain coded symbol value of the row (74) of coded symbol signal values 74, however, can show up in a plurality of instances and each instance is associated with a video pointer address. There is provided a second pseudo random number generator 70 which generates position video pointer addresses 0, 1, 2, 3 and so on, and which selects a position pointer address of the virtual video reel pointer 72 corresponding to the previously determined coded symbol value in the row (74) of the coded symbol signal values 74 of the virtual video reel V1. The purpose of this virtual video reel 68 is to find an upper subsidiary display symbol 181 and a lower subsidiary display symbol 182 to the main display symbol 180. According to a particular embodiment, the position pointer address of the virtual video reel V1 is determined for a certain coded symbol value and then the number 1 is subtracted from the position pointer address of the main display symbol for determining the upper subsidiary display symbol, and the number 1 is added to the position pointer address of the main display symbol to determine the lower subsidiary display symbol based on the position pointer address of the main symbol +1. The video reel memory 68 transfers the position pointer addresses for the upper subsidiary display symbol, for the main display symbol, and for the lower subsidiary display symbol of a respective display zone 120, 122, 124, 126, 128, 130, 132, 134 through signal lines 84 to the display control circuit 86. The display control circuit 86 then delivers these pointer position addresses of the video reel memory 68 to a second video reel memory 94 and derives from the virtual video reel V1 of the second video reel memory 94 the coded symbol values associated with the upper subsidiary display symbol, the main symbol and the lower subsidiary display symbol of the display zones 120, 122, 124. These coded symbol values 98, 102, 106 are delivered through signal lines 88, 90, 92 to the symbol memory 146 which provides for the graphic presentation of the corresponding display pictures to the display control circuit 86 and the display control circuit 86 delivers these images through a signal line 112, 114 to the display 116.

In order to be able to create the simulation and suggestion of rotating reels, a reel motion memory 110 is employed. This reel motion memory 110 provides in general pictures of only a limited number of the symbols, which are available in the symbol memory 146 or, respectively, correspond to the coded symbol values provided in the background reel memory 48. This is for the purpose of providing a more realistic impression and suggestion of a rotating reel. The reel motion memory 110 is running during a time beginning shortly after the game start signal is delivered through line 138 and up to the point in time when the respective virtual fortune reel is stopped and the winning symbol is being displayed for a particular display zone. Thus, the display control circuit 86 delivers images from the reel motion memory 110 during the time the respective virtual fortune reel is in motion and the display control circuit 86 transmits symbols corresponding to the selection in the video reel memory 68, 94 immediately upon stoppage of the imaginary rotating reel. The images from the reel motion memory 110 are stopped immediately prior to presentation of symbols corresponding to the signals from the video reel memory 68, 94, and thus also the imaginary rotating reel.

FIG. 4 and FIG. 5 show the course of the process steps performed by the video machine. Decision step 171 determines if the start conditions for a game have been met, such as for example the feeding of a coin. If the start conditions have not been met, no further process signal is delivered. If the conditions for a game start have been met, then a trigger signal is delivered to the first pseudo random number generator 36 and a pseudo random number is selected in a pseudo random number selection step 161. The selected pseudo random number is then delivered to the background reel position control unit 40 and the pseudo random number is converted in a conversion step 162 into a virtual background reel position pointer address 50, 54, 58 for each of the virtual background reels R1, R2, R3 present in the background reel memory 48. The background reel memory 48 then receives the converted signals from the background reel position control unit 40, and in a coded symbol signal generation step 163 the background reel memory 48 assigns coded symbol signal values 52, 56, 60 for each of the virtual background reels R1, R2, R3 present. The background reel memory 48 then delivers the corresponding coded symbol signal values 52, 56, 60 to the processor 24 for providing a determination of any winning combinations and for determination of the resulting distribution and payout amount of the winning combination.

Process step 160 resets the condition parameter p for stopping the reel of the respective display zone 120 to p=1. A stage 166 then sends a game start signal to the display control circuit 86. The coded symbol signal values 52, 56, 60 are then further delivered from the background reel memory 48 to the video reel memory 68 for determining virtual video reel position pointer addresses 72, 76, 80 in a step 164 for detecting video reel symbol signal values 74, 78, 82 from the video reel memory 68. The video reel memory 68 then delivers the video reel symbol signal values 74, 78, 82 of the video reel memory 68 to the display control circuit 86. The display control circuit 86 correlates these signals to the n display zones 120, 122, 124, 126, 128, 130, 132, 134, 136 provided on the video screen 118. When p=1, all reels are still rotating as controlled by the reel motion memory 110. While the initial reset value or a later determined value of p less than n is present, then certain display zones continue the showing of a rotating reel based on the signals delivered from the reel motion memory 110 on the display zones from p to n. Decision step 172 (FIG. 5) of the display control circuit 86 then determines if the value of p has already reached the number n of total display zones.

If the number p is still smaller than n, then a signal is delivered to a decision step 174 (FIG. 5) to determine if the time period left over for running the changing images delivered by the reel motion memory 110 for the display zone p is still a value or if the remaining time period has decreased to zero. If the remaining time period for the random reel motion has not yet reached a zero value, then the decision step 174 returns control to the input of the decision step 172. If, on the other hand, the time period left for displaying changing images from the random reel motion memory 110 has decreased to zero, then the decision step 174 delivers a signal to a process step 308, shown in FIG. 6, initiating a generating of coded video symbol signal values for display zones. The time period left for the random reel motion refers to the particular virtual video reel and display zone p. The total time period of the video reel motion is in contrast the total time until the last virtual video reel has come to a stop or, in other words, where all the display zones have started showing a stationary reel and a stationary picture.

If the decision step 172 finds that the last one of the display zones 136 has been reached, then a signal is sent to a decision step 173 determining if the total time period remaining for the video reel motion has decreased to zero or not. If the total time period of the display reel motion has not yet decreased to zero, then a command is given to the decision step 174 to determine if the random reel motion time of the display zone p has come to zero.

If the total time period of the display reel motion has decreased to zero, then a command is given to the process step 308, shown in FIG. 6, to initiate a generating of display images corresponding to coded video symbol signal values 74, 78, 82, and 98, 102, 106.

The process step 308 then leads to loading symbol data to the display control circuit 86 in a process step 309, shown in FIG. 6, from the symbol memory 146. The display control circuit 86 then delivers display signals, corresponding to the coded symbol values 74, 78, 82, to the display 116 for displaying the respective symbols drawn from the symbol memory 146 in the display zones according to process step 310 shown in FIG. 6.

A decision step 175 then determines if all the display zones show the stationary picture with the symbols from the symbol memory 146, that is, if p is equal to n or not. If p is not yet equal to n, then the number p is incremented by 1 in the process step 170 and the process step 170 turns control over to the process step 172 determining if the parameter p already equals the total number of display zones n.

If the decision step 175 finds that p is equal to n and that all display zones show the stationary end picture determined by the background reel memory 48 and the video reel memory 68, then, if appropriate, a winning amount is paid out.

A decision step 301 in FIG. 6 determines if a game start signal was received. If no game start signal is received, then the display shows for all display zones the symbols which resulted at the end of the immediately preceding game. This loop continues until a signal is received that a new game has started.

When a new game is started, then the decision step 301 is followed by a reset step 298, where the running parameters i and j are reset to i=0 and j=0. The parameter i serves to increment the sequence of reel motion pictures available in the reel motion memory 110. The parameter j serves to increment the sequence of the display zones. Thus, whenever a game is started, then j is reset to be 0 and to run again through all the display zones. FIG. 6 then shows the steps employed for controlling the display. Such control flow as provided in FIG. 6 is employed for each display zone by running through the diagram of FIG. 6 for each display zone based on the parameter j. Generally, the imaginary reels are stopped sequentially, first, the first row from left to right, then the second row and the third row. The parameter p designates the highest number of an imaginary reel which has stopped to rotate. The parameter j can assume values from 0 to n, wherein n is the total number of display zones employed.

A first decision is made at 302 if a video reel position signal has been received based on a delay initiated by the third pseudo random generator. If no video reel position signal has been received, then display reel motion pictures are displayed on the respective display zone. There is a number of sequentially appearing and possibly different reel motion pictures. The parameter i can assume values from 0 to a and is a running parameter for the set of display reel motion pictures to be displayed. The step 303 involves loading a reel motion picture associated with the parameter value i. According to step 304, this reel motion picture i is then displayed on the display zone p+j.

Then a decision is made in decision step 306 whether p+j has already reached the value n or not. If not, then j is incremented in a step 326 to j+1. In case where p+j=n, then j is reset to 0 so that j can again run through all the display zones present. Thereupon the value of i is incremented in incremental step 336. Then a test is made whether the parameter i is smaller or equal to a. If the parameter i is equal to a, then the parameter i is reset to 0 and the display runs again through the available reel motion pictures from the beginning i=0. If the parameter i is smaller than a, then the picture corresponding to the incremented value i will be shown next.

If the video reel position signal has been received, then respective color video signals are generated for the display zone j according to block 308. These symbol data are then loaded to the display control circuit 86 according to step 309. The display control circuit then displays these signals on the display screen 118 according to step 310. Then the video reel position signal is deleted from the display control circuit according to step 311. Then, decision step 312 determines if p has already reached the value n or not. If the value of p is smaller than n, then the value p is directly fed back for a decision if a video reel position signal has been received for the display zone p.

Alternatively, it is also conceivable to provide separate sequences of steps like those shown in FIG. 6, where, however, for each display zone a separate logic flow is provided such that the incrementation of the parameter j is no longer required.

By way of example, these steps can be expressed analytically as the following process, wherein the following definitions are employed:

fpseudo=drawn first pseudo random number
reelmax[n]=Maximum steps of values per virtual background reel [n]
pnr[n]=position number pointer address assumed by virtual background reel [n] (reference numerals 50, 54, 58)
temp[n−1]=int(fpseudo/reelmax[n−1])=intermediate value used in calculating pnr[n]
ssvr[x]=code of symbol signal value of virtual background reel [n]
ssvr[x,p]=code of symbol shown on part of display zone
svr[x,p]=symbol data associated with code of symbol ssvr [x,p]
psvr[x]=position number pointer address assumed by virtual video reel [m]
R[n]=reel memory of virtual background reel [n]
V[m]=reel memory virtual video reel [m]
n=reference number of virtual background reel.
m=reference number of virtual video reel.
x=reference number of display zone, wherein x=1, 2, 3 corresponds to n=1; x=4, 5, 6 corresponds to n=2; and x=7, 8, 9 corresponds to n=3.
p=section of display zone (main or center symbols, 180, 190, 200, 210, 220; upper subsidiary symbols, 181, 191, 201, 211, 221; or lower subsidiary symbols, 182, 192, 202, 212, 222)
m corresponds to n in the embodiment shown.

a) Generation of pseudo random number assuming values between 0 and ((reelmax[1] * reelmax[2] * reelmax[3]) −1)

b) Converting the drawn pseudo random number to virtual background reel position pointer addresses:
pnr[n]=value between 0 and (reelmax[n]−1)
pnr[1]=modulo(fpseudo/reelmax[1])
temp[1]=int(fpseudo/reelmax[1])
pnr[2]=modulo(temp[1]/reelmax[2])
temp[2]=int(temp[1]/reelmax[2])
pnr[3]=modulo(temp[2]/reelmax[3])

c) Generating symbol signal values (52, 56, 60) based on corresponding virtual background reel position pointer addresses (50, 54, 58):
ssvr[1]=R[1] [pnr[1]−1]
ssvr[2]=R[1] [pnr[1]]
ssvr[3]=R[1] [pnr[1]+1]
ssvr[4]=R[2] [pnr[2]−1]
ssvr[5]=R[2] [pnr[2]]
ssvr[6]=R[2] [pnr[2]+1]
ssvr[7]=R[3] [pnr[3]−1]
ssvr[8]=R[3] [pnr[3]]
ssvr[9]=R[3] [pnr[3]+1]

d) Determine coincidence of the symbol signal value ssvr[x] and of coded symbol values (74, 78, 82) available on the corresponding virtual video reel (V1, V2, V3) and select one virtual video reel pointer address (72, 76, 80) on the virtual video reel V[m] for each symbol signal value ssvr[x] based on signal from second pseudo random number generator (70):
psvr[x]=virtual video reel pointer address (72, 76, 80) for ssvr[x] (74, 78, 82) selected according to input from second pseudo random number generator (70):
psvr[1]=pointer address to selected ssvr[1] from V[1] (74)
. . .
psvr[9]=pointer address to selected ssvr[9] from V[3] (82).

e) Generate a total of 27 video display symbol values (180, 181, 182, 190, 191, 192, 200, 201, 202, 210, 211, 212, 220, 221, 222) for 9 display zones (120, 122, 124, 126, 128, 130, 132, 134, 136) from the video reel memory (68):
ssvr[1,u]=V[1] [psvr[1]−1]
ssvr[1,c]=V[1] [psvr[1]]
ssvr[1,1]=V[1] [psvr[1]+1]
ssvr[2,u]=V[1] [psvr[2]−1]
. . .
ssvr[8,1]=V[3] [psvr[8]+1]
ssvr[9,u]=V[3] [psvr[9]−1]
ssvr[9,c]=V[3] [psvr[9]]
ssvr[9,1]=V[3] [psvr[9]+1]

f) Load symbol data from symbol memory (146) to the display control circuit (86):
svr[1,u]=loaded from symbol memory per code ssvr[1,u]
svr[1,c]=loaded from symbol memory per code ssvr[1,c]
svr[1,1]=loaded from symbol memory per code ssvr[1,1]
svr[2,u]=loaded from symbol memory per code ssvr[2,u]
. . .
svr[8,1]=loaded from symbol memory per code ssvr[8,1]
svr[9,u]=loaded from symbol memory per code ssvr[9,u]
svr[9,c]=loaded from symbol memory per code ssvr[9,c]
svr[9,1]=loaded from symbol memory per code ssvr[9,1]

g) Display symbols (180, 181, 182, 190, 191, 192, 200, 201, 202, 210, 211, 212, 220, 221, 222) on respective display zone (120, 122, 124, 126, 128, 130, 132, 134, 136) of CRT (116).

Figure 8:
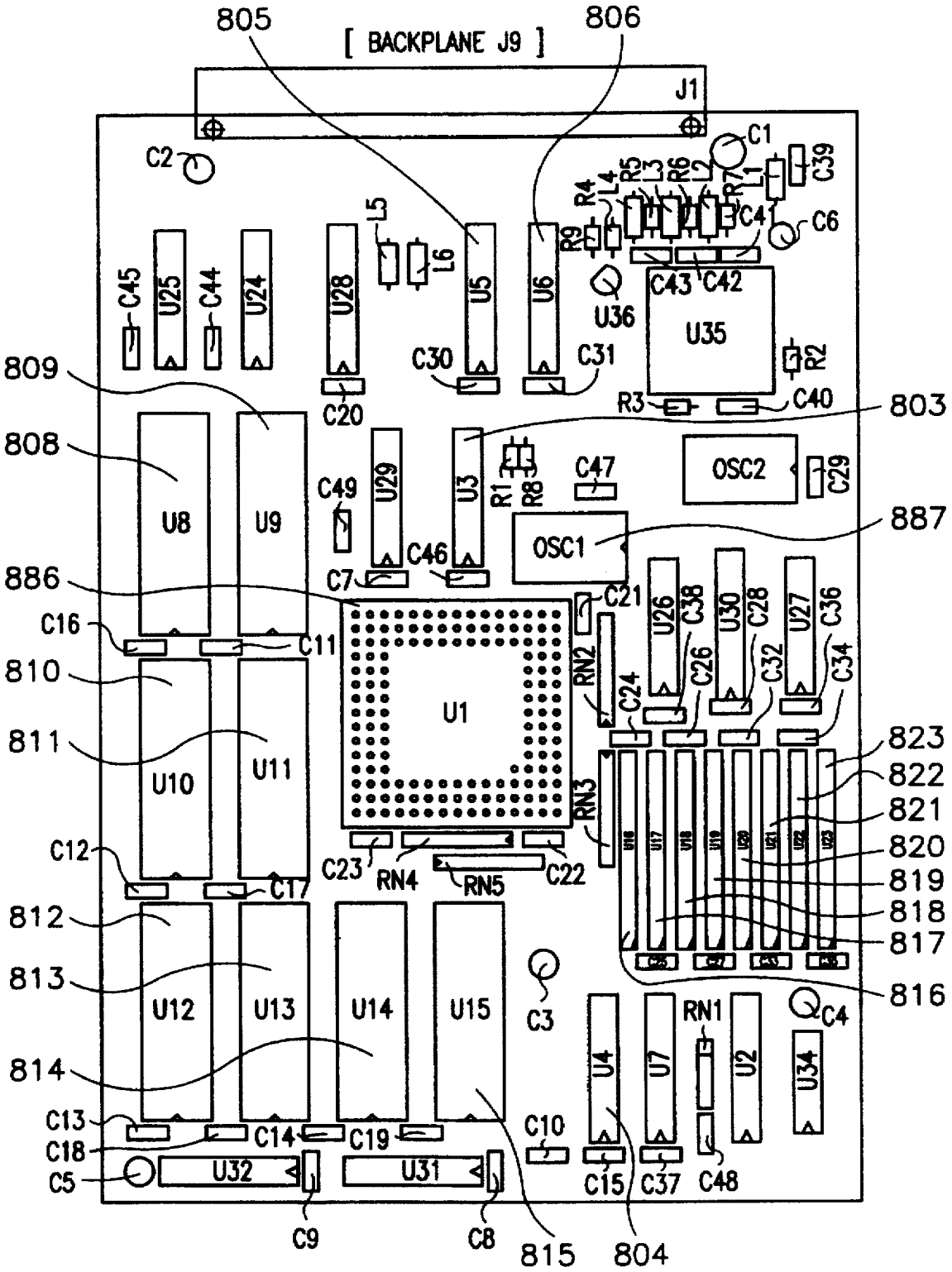
FIG. 8 is a schematic view of a graphics circuit board to be employed in connection with the main circuit board according to FIG. 7 and for providing the graphics functions provided according to the schematic block diagram of FIG. 1.
Figure 9:
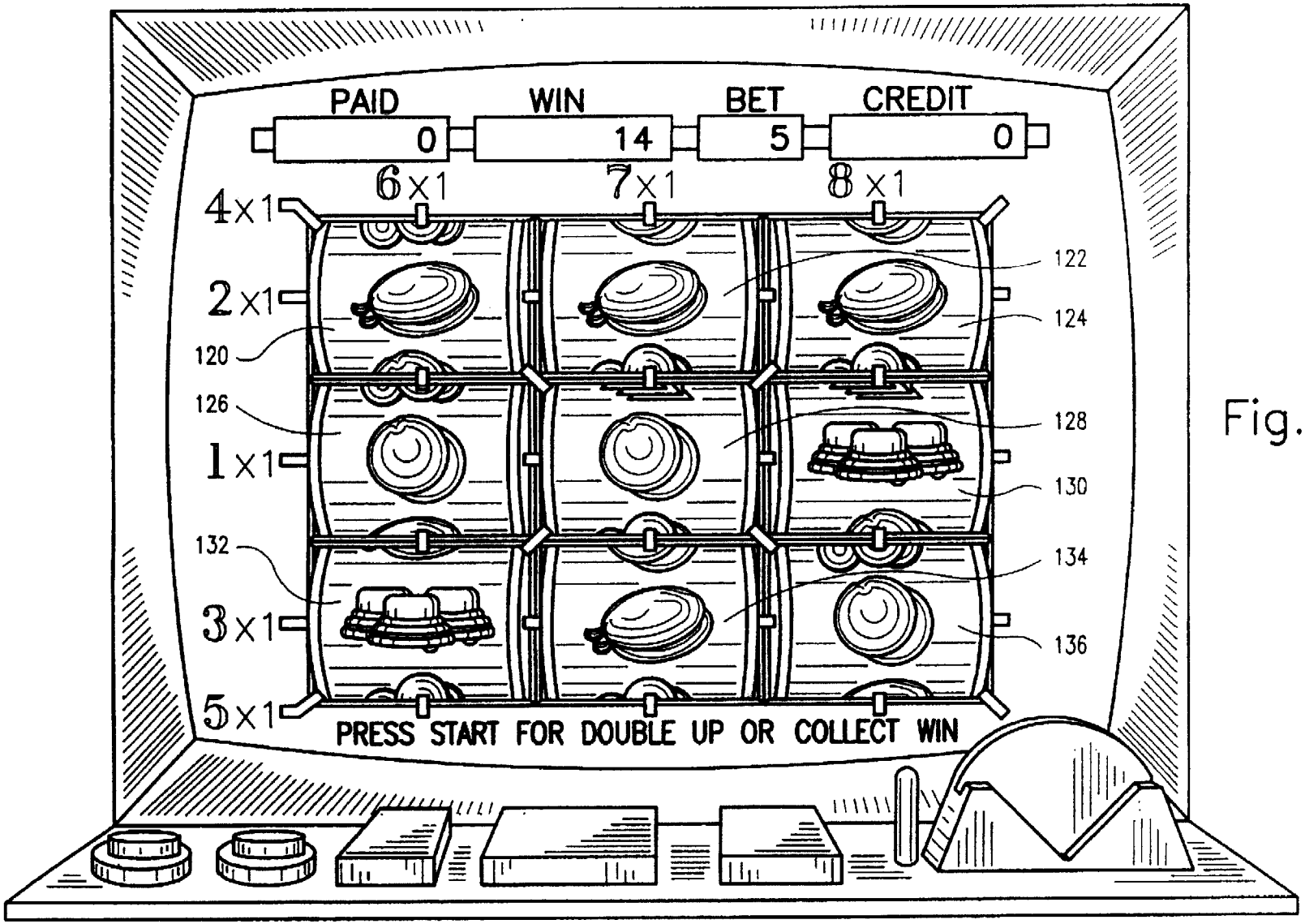
FIG. 9 is a view of a typical display of the invention system.

A specific example of parts of such a slot machine device are shown by way of circuit board outlines in FIGS. 7 and 8. The processor 24 is represented in this embodiment by the processor 724 provided as model HD64180-PLLC and the clock cycle generator 701 provided as a quartz generator of 12 MHz frequency and sustaining a clock cycle of 6 MHz for the processor 724. The processor 724 is connected to a parallel bus. An EPROM 702 is provided by model 27C010 (or 27C2001 or 27C4001) having an address region, e.g. from 00000H to 1FFFFH if an EPROM model 27C010 is used. The EPROM 702 stores the main software controlling the whole course of the game with the exception of the video animation. The sound to be provided, in particular during the game, is digitally stored in the EPROM 706, which is also provided by a model 27C010 (or 27C2001 or 27C4001) and which uses an address range starting at the end of EPROM 702 address region, e.g. 20000H to 3FFFFH. A random access memory RAM 703 employs a device DS 1386 with non-volatile random access memory RAM having an address region from F8000H to FFFFFH. The random access memory 703 includes a real time clock, an alarm, and a watchdog timer. The RAM 703 internally includes a lithium battery and a quartz, thereby avoiding a need for external control circuits. A sound circuit 726 employs model MSM 6585 to control a sound generation. A generic array logic GAL 735 of type 22V10 is employed for security purposes. The generic array logic GAL 22V10 is programmable by the user and contains a formula specific for a certain package of software. Thus, a like software package will not function where the generic array logic GAL 735 is not adapted to the specific package and does not contain the specific formula matching the formula of the corresponding software package. A second generic array logic GAL 722 of the type 16V8 is responsible for the address decoding of the input output I/O devices. A third generic array logic GAL 732 is responsible for the address decoding of the random access memory RAM 703 and of the EPROMS 702 and 706. The presence of the generic array logic 722, 732 allows to implement complicated and extensive logic sequences in a simple and effective way.

A serial $I_2C$-bus controller 717 is provided by a device of the type PCD 8584 representing a master on the main board. The controller 717 serves as an intersection between the parallel bus of the processor 724 serial $I_2C$-bus. The device of the type PCD 8584 can be employed both as a master and as a slave and, consequently, a bidirectional communication becomes possible between the parallel bus of the processor 724 and the $I_2C$-bus. Dip switches 719, 720, 734 are provided and are read in through a device of the type 74HC257. The various voltages provided and employed are optically controlled by light emitting diodes: 791 (red)=+5V; 792 (yellow)=+12V; 793 (yellow)=−12V; and 794 (green) +24V.

The graphics circuit board shown in FIG. 8 is connected to the main circuit board of FIG. 7. The display control circuit 86 includes the processor 886 implemented by a device of the type TMS34020-PGA and by a quartz oscillator 887 having a clock cycle frequency of 32 MHz and supporting a clock speed of 16 MHz for the processor 886. The images of the video animation and the orders from the main board are interpreted by erasable programmable read-only memories EPROMs of the type 27C2001 or 27C4001 designated with reference numerals 808, (809), 810, (811), 812, (813), and 814, (815). If the images are taking less memory, just four EPROMs are needed with reference numerals 808, 810, 812, and 814. The actual and current images to be displayed at the monitor 116 are contained in video random access memory VRAM circuits of type 44C251-100 and are designated with reference numerals 816, 817, 818, 819, 820, 821, 822, and 823. The generic array logic GAL devices 803, 804, 805, 806, and 807 are provided by devices of the type 16V8. The generic array logic GAL device 803 includes the host interface between the main circuit board and the graphics circuit board. The address decoding for the EPROMs 808, 809, 810, 811, 812, 813, 814, and 815 is provided by the generic array logic GAL device 804. The course in time of the video signals is controlled by the generic array logic GAL devices 705 and 706. The decoding of the video random access memory VRAM devices 816, 817, 818, 819, 820, 821, 822, and 823 is furnished by the generic array logic GAL device 807. A color converter is furnished by RGB-converter 835 of the type BT477-35.

It will be understood that each of the elements described above, or two or more together, may also find a useful application in other types of entertainment apparatuses and slot machines differing from the types described above.

While the invention has been illustrated and described as embodied in the context of a video slot machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A slot machine device comprising an input sensor for sensing tokens delivered to a slot machine;

a processor connected to the input sensor for receiving information about tokens entered into the slot machine and for initiating a cycle of the slot machine;

a first pseudo random number generator connected to the processor for being triggered upon sensing a token input;

a background position control unit connected to the first pseudo random number generator for associating a plurality of position pointer addresses to a signal from the first pseudo random number generator;

a display including a video screen and having a plurality of display zones for displaying symbols determined for each display zone of the plurality of display zones;

a virtual background reel memory including a plurality of virtual background reel memory sections, where each virtual background reel memory section is coordinated to a corresponding one of the plurality of position pointer addresses and connected to the processor for delivering to the processor a final configuration of the cycle, and wherein said each virtual background reel memory section determines coded symbol signal values of a plurality of main display symbols, where each of the plurality of main display symbols is displayed in a center of one of the plurality of display zones;

a winning combination memory connected to the processor for allowing the processor to compare the plurality of pointer position addresses of the virtual background reel memory with winning combinations;

an output control connected to the processor for delivering a winning payout amount when a winning combination was delivered by the plurality of pointer position addresses of the plurality of virtual background reel memory sections wherein a number of display zones is larger than a number of virtual background reel memory sections;

a video reel memory connected to the virtual background reel memory for determining coded symbol signal values of subsidiary display symbols associated with said each of the plurality of main display symbols;

a display control circuit connected to the display and connected to the video reel memory for receiving the coded symbol signal values of the subsidiary display symbols determined by the video reel memory and for receiving the coded symbol values of the plurality of main display symbols determined by the virtual background reel memory, wherein the display control circuit controls the display by displaying the plurality of main display symbols and by displaying the subsidiary display symbols associated with said each of the plurality of main display symbols; and a symbol memory connected to the display control circuit for delivering symbol signals corresponding to coded symbol signal values received from the video reel memory.

2. The slot machine device according to claim 1, further comprising a reel motion memory connected to the display control circuit for delivering simulated pictures of rotating reels to the display control circuit and thereby to the video screen of the display.

3. The slot machine device according to claim 1, wherein the video reel memory includes a plurality of sections of virtual video reel memory associated such that some of the virtual background reel memory sections are assigned to different virtual video reel memory sections.

4. The slot machine device according to claim 1, wherein the video reel memory includes a plurality of sections of virtual video reel memory associated such that each of the virtual background reel memory sections is assigned to a different virtual video reel memory section.

5. The slot machine device according to claim 1, further comprising a connection between the display control circuit and the processor for delivering a signal to the processor indicating that a game is over.

6. The slot machine device according to claim 1, further comprising a connection between the display control circuit and an output of the processor for delivering a game start signal from the processor to the display control circuit.

7. The slot machine device according to claim 1, wherein the display is provided by a cathode ray tube.

8. A slot machine device comprising an input sensor for sensing tokens delivered to a slot machine;

a processor connected to the input sensor for receiving information about tokens entered into the slot machine and for initiating a cycle of the slot machine;

a first pseudo random number generator connected to the processor for being triggered upon sensing a token input;

a background position control unit connected to the first pseudo random number generator for associating a plurality of position pointer addresses to a signal from the first pseudo random number generator;

a display including a video screen and having a plurality of display zones for displaying symbols determined for each display zone of the plurality of display zones;

a virtual background reel memory including a plurality of virtual background reel memory sections, where each virtual background reel memory section is coordinated to a corresponding one of the plurality of position pointer addresses and connected to the processor for delivering to the processor a final configuration of the cycle, and wherein said each virtual background reel memory section determines coded symbol signal values of a plurality of main display symbols, where each of the plurality of main display symbols is displayed in a center of one of the plurality of display zones;

a winning combination memory connected to the processor for allowing the processor to compare the plurality of pointer position addresses of the virtual background reel memory with winning combinations;

an output control connected to the processor for delivering a winning payout amount when a winning combination was delivered by the plurality of pointer position addresses of the plurality of virtual background reel memory sections wherein a number of display zones is larger than a number of virtual background reel memory sections;

a video reel memory connected to the virtual background reel memory fr determining coded symbol signal values of subsidiary display symbols associated with said each of the plurality of main display symbols;

a display control circuit connected to the display and connected to the video reel memory for receiving the coded symbol signal values of the subsidiary display symbols determined by the video reel memory and for receiving the coded symbol values of the plurality of main display symbols determined by the virtual background reel memory, wherein the display control circuit controls the display by displaying the plurality of main display symbols and by displaying the subsidiary display symbols associated with said each of the plurality of main display symbols;

a symbol memory connected to the display control circuit for delivering symbol signals corresponding to coded symbol signal values received from the video reel memory;

a reel motion memory connected to the display control circuit for delivering simulated pictures of rotating reels to the display control circuit and thereby to the video screen of the display;

a second pseudo random number generator associated with the video reel memory for determining the subsidiary display symbols to be displayed in connection with each main display symbol in a display zone; and a third pseudo random number generator connected to the display control circuit for setting time periods of showing the simulated pictures of rotating wheels.

9. A slot machine device comprising an input sensor for sensing tokens delivered to a slot machine;

a processor connected to the input sensor for receiving information about tokens entered into the slot machine and for initiating a cycle of the slot machine;

a first pseudo random number generator connected to the processor for being triggered upon sensing a token input;

a background position control unit connected to the first pseudo random number generator for associating a plurality of position pointer addresses to a signal from the first pseudo random number generator;

a display including a video screen and having a plurality of display zones for displaying symbols determined for each display zone of the plurality of display zones;

a virtual background reel memory including a plurality of virtual background reel memory sections, where each virtual background reel memory section is coordinated to a corresponding one of the plurality of position pointer addresses and connected to the processor for delivering to the processor a final configuration of the cycle, and wherein said each virtual background reel memory section determines coded symbol signal values of a plurality of main display symbols, where each of the plurality of main display symbols is displayed in a center of one of the plurality of display zones;

a winning combination memory connected to the processor for allowing the processor to compare the plurality of pointer position addresses of the virtual background reel memory with winning combinations;

an output control connected to the processor for delivering a winning payout amount when a winning combination was delivered by the plurality of pointer position addresses of the plurality of virtual background reel memory sections wherein a number of display zones is larger than a number of virtual background reel memory sections;

a video reel memory connected to the virtual background reel memory for determining coded symbol signal values of subsidiary display symbols associated with said each of the plurality of main display symbols;

a display control circuit connected to the display and connected to the video reel memory for receiving the coded symbol signal values of the subsidiary display symbols determined by the video reel memory and for receiving the coded symbol values of the plurality of main display symbols determined by the virtual background reel memory, wherein the display control circuit controls the display by displaying the plurality of main display symbols and by displaying the subsidiary display symbols associated with said each of the plurality of main display symbols;

a symbol memory connected to the display control circuit for delivering symbol signals corresponding to coded symbol signal values received from the video reel memory;

a second virtual video reel memory connected to the display control circuit such that coded symbol signal values, received from a first virtual video reel memory, are associated in the display control circuit to display symbols.

10. A method for operating a slot machine comprising the steps:

feeding a token into a slot machine;

sensing entry of the token into the slot machine with a sensor;

delivering a signal corresponding to the entry of the token from the sensor to a processor;

starting a game with the processor;

delivering a game start signal from the processor to a first pseudo random number generator;

delivering an output signal of a first pseudo random number from the first pseudo random number generator to a background reel position control unit;

deriving a plurality of signals corresponding to virtual background reel pointer addresses from the first pseudo random number in the background reel position control unit;

delivering the plurality of signals corresponding to the virtual background reel pointer addresses from the background reel position control unit to a virtual background reel memory;

coding the plurality of signals corresponding to the virtual background reel pointer addresses into coded symbol signal values;

transmitting the coded symbol signal values from the virtual background reel memory to a virtual video reel memory;

transmitting virtual video reel position pointer addresses corresponding to the coded symbol signal values from the virtual video reel memory to a display control circuit;

controlling a display having a plurality of display zones with the display control circuit wherein a number of display zones is larger than a number of pseudo random numbers delivered to the virtual background reel for a display picture.

11. The method for operating a slot machine according to claim 10, further comprising the steps:

delivering a game start signal from the processor to the display control circuit;

transmitting coded symbol signal values from the virtual background reel memory to the processor;

comparing the coded symbol signal values transmitted to the processor with winning combinations stored in a winning combinations memory connected to the processor;

delivering a game over signal from the display control circuit to the processor for allowing start of a new game.

12. The method for operating a slot machine according to claim 10, wherein a number of virtual background reels corresponds to a number of columns of the display zones.

13. The method for operating a slot machine according to claim 10, wherein a number of virtual background reels corresponds to a number of rows of the display zones.

14. A method for operating a slot machine, comprising the steps:

feeding a token into a slot machine;

sensing entry of the token into the slot machine with a sensor;

delivering a signal corresponding to the entry of a token from the sensor to a processor;

starting a game with the processor;

delivering a game start signal from the processor to a first pseudo random number generator;

delivering an output signal of a first pseudo random number from the first pseudo random number generator to a background reel position control unit;

deriving a plurality of signals corresponding to virtual background reel pointer addresses from the first pseudo random number in the background reel position control unit;

delivering the plurality of signals corresponding to the background reel pointer addresses from the background reel position control unit to a virtual background reel memory;

transmitting coded symbol signal values from the virtual background reel memory to a virtual video reel memory;

transmitting virtual video reel position pointer addresses from the virtual video reel memory to a display control circuit;

connecting a reel motion memory to the display control circuit;

displaying upon start of a game a simulated reel rotation with display signals from the reel motion memory on the display;

controlling a display with the display control circuit;

determining a third pseudo random number in a pseudo random number generator for setting rotation run times of individual display zones.

15. A method for operating a slot machine, comprising the steps:

sensing entry of a token into the machine with a sensor;

delivering a signal corresponding to the entry of a token from the sensor to a processor;

starting a game with the processor;

delivering a game start signal from the processor to a first pseudo random number generator;

delivering an output signal of a first pseudo random number from the first pseudo random number generator to a background reel position control unit;

delivering a plurality of signals corresponding to virtual background reel pointer addresses from the background reel position control unit to a virtual background reel memory;

transmitting coded symbol signal values from the virtual background reel memory to a virtual video reel memory;

selecting a second pseudo random number in a second pseudo random number memory;

delivering the second pseudo random number to the virtual video reel memory for assigning virtual video reel position pointer addresses associated with the coded symbol signal values of main display symbols for determining subsidiary display symbols displayed above and below of the main display symbol disposed centered in the display zone;

transmitting the coded symbol signal values associated with the main display symbol and the subsidiary display symbols to the display control circuit;

transmitting virtual video reel position pointer addresses from the virtual video reel memory to a display control circuit;

controlling a display with the display control circuit.

16. A method for operating a slot machine, comprising the steps:

feeding a token into a slot machine;

sensing entry of the token into the slot machine with a sensor;

delivering a signal corresponding to the entry of the token from the sensor to a processor;

starting a game with the processor;

delivering a game start signal from the processor to a first pseudo random number generator;

delivering an output signal of a first pseudo random number from the first pseudo random number generator to a background reel position control unit;

deriving a plurality of signals corresponding to virtual background reel pointer addresses from the first pseudo random number in the background reel position control unit;

delivering the plurality of signals corresponding to the background reel pointer addresses from the background reel position control unit to a virtual background reel memory;

transmitting coded symbol signal values from the virtual background reel memory to a virtual video reel memory;

transmitting virtual video reel position pointer addresses from the virtual video reel memory to the display control circuit;

connecting a second virtual video reel memory to the display control circuit;

transmitting the virtual video reel position pointer addresses from the display control circuit to the second virtual video reel memory;

transmitting the virtual video reel position pointer addresses from the display control circuit to the second virtual video reel memory;

transmitting coded video symbol signal values from the second virtual video reel memory to the display control circuit;

transmitting virtual video reel position pointer addresses from the virtual video reel memory to a display control circuit;

controlling a display with the display control circuit.

17. A method for operating a slot machine, comprising the steps:

feeding a token into a slot machine;

sensing entry of the token into the slot machine with a sensor;

delivering a signal corresponding to the entry of the token from the sensor to a processor;

starting a game with the processor;

delivering a game start signal from the processor to a first pseudo random number generator;

delivering an output signal of a first pseudo random number from the first pseudo random number generator to a background reel position control unit;

deriving a plurality of signals corresponding to virtual background reel pointer addresses from the first pseudo random number in the background reel position control unit;

delivering the plurality of signals corresponding to the background reel pointer addresses from the background reel position control unit to a virtual background reel memory;

transmitting coded symbol signal values from the virtual background reel memory to a virtual video reel memory;

transmitting virtual video reel position pointer addresses from the virtual video reel memory to a display control circuit;

controlling a display with the display control circuit;

wherein a number of virtual background reels corresponds to a number of columns of the display zones, and wherein the main display symbols displayed in a column of display zones corresponds to a neighboring sequence of pointer addresses and corresponding coded symbol signal values on the respective virtual background reel.

18. The method for operating a slot machine according to claim 17, wherein the main display symbol, an upper subsidiary display symbol shown above the main display symbol, and a lower subsidiary display symbol shown below the main display symbol, displayed in each one of the display zones, correspond to coded symbol signal values disposed in a neighboring sequence of pointer addresses and corresponding coded symbol signal values on the respective virtual video reel associated with the respective virtual background reel.

19. A method for operating a slot machine, comprising the steps:

feeding a token into a slot machine;

sensing entry of the token into the slot machine with a sensor;

delivering a signal corresponding to the entry of the token from the sensor to a processor;

starting a game with the processor;

delivering a game start signal from the processor to a first pseudo random number generator;

delivering an output signal of a first pseudo random number from the first pseudo random number generator to a background reel position control unit;

deriving a plurality of signals corresponding to virtual background reel pointer addresses from the first pseudo random number in the background reel position control unit;

delivering the plurality of signals corresponding to the background reel pointer addresses from the background reel position control unit to a virtual background reel memory;

transmitting coded symbol signal values from the virtual background reel memory to a virtual video reel memory;

transmitting virtual video reel position pointer addresses from the virtual video reel memory to a display control circuit;

controlling a display with the display control circuit;

wherein a number of virtual background reels corresponds to a number of rows of the display zones; and wherein the main display symbols, displayed in a row of display zones, correspond to a neighboring sequence of pointer addresses and corresponding coded symbol signal values on the respective virtual background reel.

20. The method for operating a slot machine according to claim 19, wherein the main display symbol, an upper subsidiary display symbol shown above the main display symbol, and a lower subsidiary display symbol shown below the main display symbol, displayed in each one of the display zones correspond to coded symbol signal values disposed in a neighboring sequence of pointer addresses and corresponding coded symbol signal values on the respective virtual video reel associated with the respective virtual background reel.

* * * * *